United States Patent [19]

Minden

[11] Patent Number: 4,589,973

[45] Date of Patent: May 20, 1986

[54] PROCESS FOR RECOVERING OIL FROM RAW OIL SHALE USING ADDED PULVERIZED COAL

[75] Inventor: Carl S. Minden, Salt Lake City, Utah

[73] Assignee: Breckinridge Minerals, Inc., Murray, Utah

[21] Appl. No.: 754,938

[22] Filed: Jul. 15, 1985

[51] Int. Cl.[4] ..... C10G 1/00; C10G 1/02; C10G 1/04; G10B 53/06

[52] U.S. Cl. ..... 208/410; 208/426; 208/417; 208/427

[58] Field of Search ..... 208/8 R, 11 R, 8 LE, 208/11 LE

[56] References Cited

U.S. PATENT DOCUMENTS

| | | | |
|---|---|---|---|
| 3,565,784 | 2/1971 | Schlinger et al. | 208/11 R |
| 4,197,183 | 4/1980 | Audeh | 208/11 LE |
| 4,337,143 | 6/1982 | Hanson et al. | 208/11 R |
| 4,409,090 | 10/1983 | Hanson et al. | 208/11 R X |
| 4,421,629 | 12/1983 | York et al. | 208/11 R X |
| 4,495,057 | 1/1965 | Amirijafari et al. | 208/11 LE X |

*Primary Examiner*—Andrew H. Metz
*Assistant Examiner*—Glenn A. Caldarola
*Attorney, Agent, or Firm*—Thorpe, North & Western

[57] ABSTRACT

A continuous process for recovering oil from raw oil shale using a new integrated hydropyrolysis/thermal pyrolysis technique and involving the addition of pulverized coal which produces oil which is more characteristic of typical crude oil, as well as providing supplemental gas and coal char fuel, and has unusually low heat and energy requirements, which process comprises passing hot and crushed raw shale to a slurry mixer where it is mixed with hot recycle heavy oil, treating the resulting slurry with hydrogen under elevated temperature and pressure for a short period, discharging the resulting mixture to a product stripper wherein the product hydrocarbons and a portion of the recycle slurry oil is vaporized and passed to a separation column where the desired fractions are removed and heavy gas oil recovered for recycle, mixing a portion of the heavy gas oil recycle with pulverized coal particles to form a pumpable coal slurry, discharging spent shale and remaining slurry oil from the product stripper to a thermal retort operated under fluidized bed conditions wherein a temperature gradient is maintained by introducing spent shale and coal char that has been burned in an air lift combustor into at least two different treatment zones, the upper zone being selected such that the temperature is sufficient to vaporize the remaining slurry oil, and the lower zone being selected such that the temperature is sufficient to thermally retort spent shale, pyrolyze coal and thermally crack excess heavy gas oil charged to the lower zone as a coal slurry, taking the product as high temperature vapor to a quench tower wherein the liquid product is recycled to the hydrogenation reactor and the heavy gas oil is recycled to the slurry mixer.

15 Claims, 2 Drawing Figures

PROCESS FOR RECOVERING OIL FROM RAW OIL SHALE USING ADDED PULVERIZED COAL

BACKGROUND OF THE INVENTION

1. Field of the Invention

This invention relates to a new process for recovering shale oil from raw oil shale. More particularly, the invention relates to a new process for treating raw oil shale using a new integrated hyrogenation/thermal pyrolysis process involving the addition of pulverized coal which produces oil which is more characteristic of typical crude oil as well as supplemental gas and coal char fuel.

Specifically, the invention provides a new and improved process for recovering oil from raw oil shale using a new integrated hydropyrolysis/thermal pyrolysis technique and involving the addition of pulverized coal which produces a combined oil product which is more characteristic of typical crude as well as supplemental gas and coal char fuel and has unusually low heat and energy requirements, which process comprises passing hot crushed and ground raw shale to a slurry mixer where it is mixed with hot recycle oil, treating the resulting slurry with hydrogen under elevated temperature and pressure for a short period, discharging the resulting mixture to a product stripper wherein the product hydrocarbons and a portion of the recycle slurry oil is vaporized and passed to a separation column where the desired fractions are removed and heavy gas oil recovered, mixing a portion of the heavy gas oil with pulverized coal particles to form a pumpable coal slurry, passing the slurry and remaining slurry oil from the product stripper to the top of the thermal retort which is operated under fluidized bed conditions such that a temperature gradient is maintained by introducing spent shale and coal char that has been burned in an air lift combustor at two or more different treatment zones, the upper zone being selected such that the temperature is sufficient to vaporize the remaining slurry oil, and the lower zone being selected such that the temperature is sufficient to retort spent shale and also pyrolyze coal and to thermally crack excess heavy oil charged to the lower zone as a coal slurry, taking the product as high temperature vapor to a quench tower where the liquid product is recycled to the hydrogenation reactor for hydrogenation and the heavy gas oil is recycled to the slurry mixer.

2. Prior Art

World wide demand for hydrocarbons and related products is continuing at a high annual rate. Crude petroleum and natural gas are basic in satisfying these demands but shortages can be forseen in the near future even though new oil and gas resources are being discovered. Therefore, alternate sources and feed stocks, such as coal, tar sands, oil shale and solid crudes are receiving greater consideration.

Oil shales found in large quantities in various locations throughout the world are an ideal source for obtaining additional quantities of hydrocarbons and related products. Oil shale consists of compacted sedimentary inorganic particles, generally laminated and partly or entirely encased with a high mol. weight organic material called kerogen, which is usually present in amounts of about 6 to 30 percent by wt. of the shale. Kerogen is derived from aquatic organisms or waxy spores and pollen grains, comprising hydrocarbons and complex organix-nitrogen, oxygen and sulfur compounds. Nitrogen in kerogen is largely present in the form of thiophene-type compounds. Crude shale oil produced from the oil shale by pyrolysis of the kerogen differs from crude petroleum by being more unsaturated and having a higher content of nitrogen-compounds. Further, poor color stability and disagreeable odor of the shale products are related to the presence of these compounds.

Prior known methods for recovering oil from raw shale used principally a thermal means and more recently the use of molecular hydrogen. These methods have not been entirely satisfactory as they have generally resulted in a low conversion to the desired high molecular weight liquid products and higher conversion of the kerogen to carbon and gas products which are of low economic value. Furthermore, the desired liquid products have been of low quality in that they have a high molecular weight and contain considerable amounts of the above-described nitrogen, sulfur, and oxygen contaminants. They also differ from the conventional crude oil in having large amounts of unsaturated aliphatic compounds and depending on the shale source little if any aromatics or cyclic compounds. Finally, many of the prior known processes have required the use of considerable amounts of energy and elaborate equipment and are thus very expensive to operate.

Prior known processes for recovering oil shale which have one or more of the above-noted deficiences include: Hoekstra—U.S. Pat. No. 4,414,433, Vasalos—U.S. Pat. No. 4,404,083, Bertelsen—U.S. Pat. No. 4,366,046, Sieg—U.S. Pat. No. 4,293,401, Tarman—U.S. Pat. No. 4,431,509, Hall—U.S. Pat. No. 4,421,603, and Schlinger—U.S. Pat. No. 3,617,470.

Prior known methods involving the addition of coal in such processes include Rankel—U.S. Pat. No. 4,404,091, Rosenthal—U.S. Pat. No. 4,395,983, Arnold—U.S. Pat. No. 3,870,621, Hemminger—U.S. Pat. No. 3,162,583 Hill—U.S. Pat. No. 4,133,742 and Reed—U.S. Pat. No. 3,939,057.

It is an object of the invention, therefore, to provide a new and efficient process for recovering shale oil from raw oil shale. It is a further object to provide a new process for recovering oil from raw oil shale which permits recovery of liquid hydrocarbon products which are more characteristic of conventional crude than possible heretofore. It is a further object to provide a process for recovering oil from raw shale in higher yields than possible heretofore. It is a further object to provide a process for recovering oil from raw shale which has significantly reduced quantities of nitrogen, oxygen and sulfur contaminants. It is a further object to provide a process for recovering oil from raw oil shale which has unusually low heat and energy requirements. It is a further object to provide a process for recovering oil from oil shale which yields large amounts of gas or liquid products for use in the manufacture of its own hydrogen requirements. It is a further object to provide a process utilizing coal char as a low cost supplemental fuel to satisfy total plant energy requirements. It is a further object to provide a process for recovering oil shale which uses equipment compatible with known processes and thus capable of being combined herewith. These and other objects and advantages of the invention will be apparent from the following detailed description thereof.

SUMMARY OF THE INVENTION

It has now been discovered that these and other objects may be accomplished by the new process of the present invention which presents for the first time a highly efficient and economical process for recovery of the desired shale oil from raw shale oil.

The new process of the invention broadly comprises the steps of crushing and grinding the raw oil shale, heating and drying the crushed and ground shale, passing the heated and dried shale particles to a slurry mixer where they are mixed with hot recycle heavy oil, passing the slurry into a pressurized hydropyrolysis chamber where it is treated with hydrogen under pressure of 500 to 2000 psi and a temperature of 400° C. to 475° C. for a short residence time, and taking steps during this reaction to prevent the temperature from rising more than approximately 25° C. above the aforementioned range, discharging the hydropyrolysis reaction mixture into a product stripper wherein the product hydrocarbons and a portion of the recycle slurry oil is vaporized and passed to a separation column where the desired fractions are removed and heavy gas oil recovered, mixing a portion of the heavy gas oil so recovered with pulverized coal particles to form a pumpable coal slurry, passing the spent shale and remaining slurry oil from the product stripper to a thermal retort which is operated under fluidized bed conditions and temperature gradient is maintained by introducing spent shale and coal char that has been burned in an air lift combustor in at least two different treatment zones, the upper zone being selected such that the temperature is sufficient to vaporize the remaining slurry oil, and the lower zone being selected such that the temperature is sufficient to thermally retort residual organic carbon and hydrogen remaining after hydropyrolysis and to thermally crack excess heavy gas oil and pyrolyze coal charged as coal slurry, taking the combined gas and liquid product to a quench tower where the liquid product is recycled to the hydropyrolysis reactor and the heavy gas oil is recycled via a slurry oil heater to the slurry mixer, and discharging the spent shale and coal char at the bottom of the thermal retort chamber to the air lift combustor, the hydrogen content of the shale leaving the thermal retort being low, e.g. in the range of 0.5 hydrogen/carbon atomic ratio or less.

The new process of the invention provides distinct advantages over the prior known methods for extracting and recovering oil from raw oil shale, and is particularly outstanding for use in the treatment of leaner oil shales having a low hydrogen to carbon ratio, such as the Devonian shales, as found in the Eastern part of the United States, such as Kentucky, Mississippi and Tennessee, and is of improved value in the treatment of the oil shales from the Eocene period such as found in the Western United States, and particularly Utah and Colorado.

Particular advantage of the new process is found in the unusually low yield of light hydrocarbon gases, such as methane which contain significantly more hydrogen per unit of carbon than the higher boiling hydrocarbons produced within the hydropyrolysis reactor, and in the high yields of the desired liquid hydrocarbons in the boiling range typical of gasoline, diesel oils and the like, that may be obtained by thermal cracking of heavy oil product within the thermal retort. In many cases, the yield of liquid hydrocarbons from Devonian shales found in the Eastern United States is from 150% to 250% of Fisher Assay, and from the Eocene shale in the Western United States from 120% to about 150% of Fisher Assay. Such high yields are obtained with minimum hydrogen loss in the spent shale.

Special features of the process, such as the selective control of the temperature permit one to obtain the optimum yields of the desired liquid products, not obtainable heretofore.

Further special advantage of the new process is found in the surprisingly improved quality of the liquid products obtained from the process. For example, while prior known products possessed considerable amounts of undesirable unsaturated hydrocarbons, such as olefinic compounds, and little if any of the desired aromatic or cyclic compounds found in conventional crude oils, the liquid products from the present process are substantially free of the the undesirable unsaturated compounds and possess increased amounts of the desired cyclic or aromatic compounds characteristic of the conventional crudes.

In addition, the liquid products from the present invention have significantly reduced amounts of the complex organic-nitrogen, oxygen and sulfur compounds which are so prevalent in the prior known products and thus exhibit improved color and stability. The new products also have significant increase in API gravity.

Additional advantage is found in the low cost of operation of the process, particularly as to the heat and energy requirements. For example, it has been found that there is sufficient heat release in the hydropyrolysis chamber to operate without the need for slurry preheat via fired heater or heat exchangers. The heat of reaction along with the heat of the recycle slurry oil permits operation without supplemental heat. In addition, the use of the burned shale ash and coal char at the various treatment zones permits one to obtain the maximum yields with the least amount of added heat.

Also of significance is the fact that the addition of coal provides supplemental fuel in the form of gas for hydrogen manufacture and coal char as fuel for a fluid bed combustor so that the plant can operate in energy balance and hydrogen plant fuel plus feed balance.

A further unexpected advantage of the present invention is the fact that the yields and efficient operation can be obtained without the use of hydrogen donor hydrocarbons or the use of catalysts, such as hydrogenation catalysts required in prior known processes using hydrogen.

BRIEF DESCRIPTION OF THE DRAWINGS

The various objects and features of the present invention will be more fully understood by reference to the accompanying drawings.

With reference to FIG. 1, the major steps include crushing and grinding the oil shale 11, heating and drying the crushed ore 12, forming a slurry with recycle heavy oil 13, treating the resulting slurry with hydrogen under elevated temperature and pressure 14, taking the slurry to product stripper 16 where the desired liquid products are steam stripped and taken to product bubble tower 21 for fractionation, removing the bottom heavy gas oil and taking a portion to slurry mixer 22 where it is combined with pulverized coal from 23, taking the resulting coal slurry to thermal retort 17 where the oil is thermally cracked and the coal is pyrolyzed, taking the spent shale and remainder of the slurry oil from the product stripper 16 to thermal retort which is operated under fluidized bed conditions such that a temperature gradient is maintained through the introduction of burned spent shale and coal char from air lift combustor 18, removing the gas and liquid products to recycle quench tower 19 with the spent shale and coal char being taken to the bottom of the air lift combustor, and the liquid product from the quench tower being recycled to the hydrogenation step 14 and the heavy oil being taken to slurry oil heater 20 where it is heated and recycled to the slurry step 13, residual carbon and hydrogen remaining on excess spent shale leaving air lift combustor 18 is burned in a fluid bed combustor as a source of plant energy.

Figure 1:
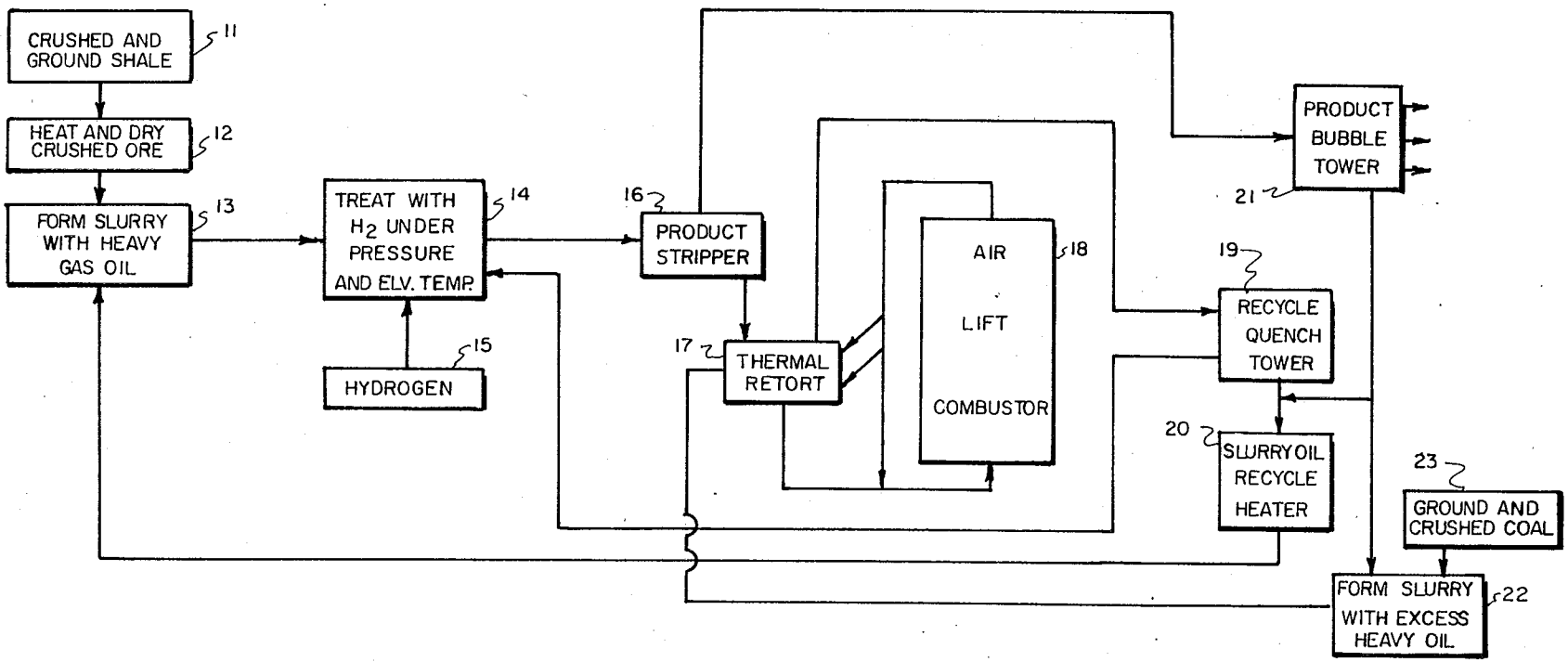
FIG. 1 is a flow chart showing the major steps in the process of the invention.
Figure 2:
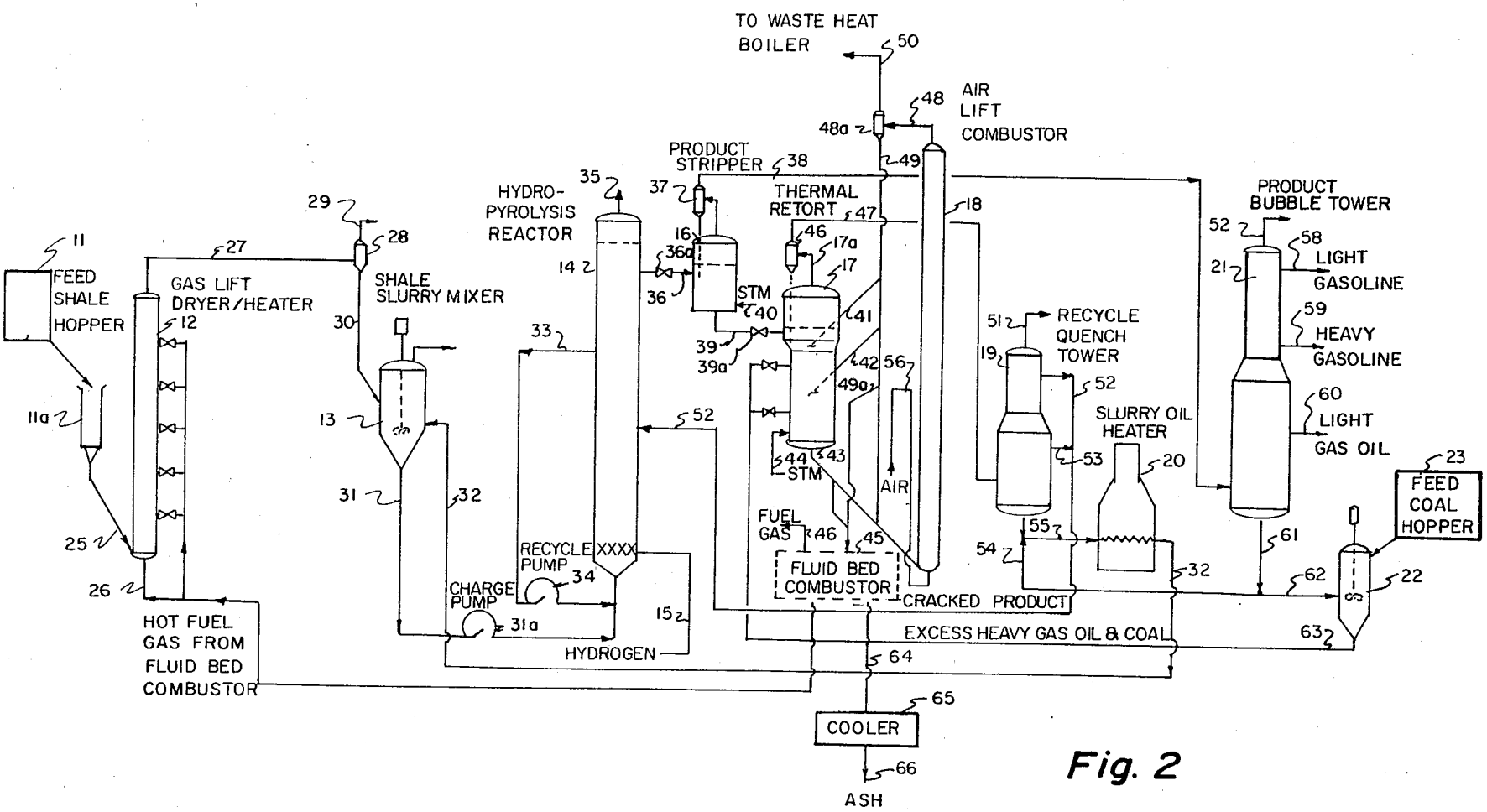
FIG. 2 is a schematic diagram of a preferred method and apparatus, although it should be understood that the drawings are not to be regarded as limiting the scope of the invention as to steps, apparatus or material to be used.

With reference now to FIG. 2 showing the preferred embodiment as to steps and apparatus, particles of raw oil shale are crushed and ground in a conventional cominution system at 11, taken to feed hopper 11*a* and through line 25 to the bottom of gas lift drier heater 12 supplied through line 26 from fluid bed combustor 45.

From the gas lift drier heater, the crushed heated shale is taken through line 27 to cyclone 28 where gas vapors are taken to a furnace for disposal through line 29 and the recovered shale at a temperature in the range of 300° C. is taken through line 30 to slurry mixer 13 where it is mixed with heavy oil recycle entering through line 32. The mixed slurry is then taken through line 31 and pumped to high pressure in pump 31*a* to the bottom of the hydropyrolysis chamber 14 where it is combined with hydrogen under pressure from line 15. A portion of the mixture in the hydropyrolysis reactor 14 is recycled to the bottom of chamber 14 through line 33 and recycle pump 34. Recycled cracked product from the quench tower is brought to reactor 14 through line 52. Gas is removed through line 35 and the product from reactor 14 is taken through valve 36*a* and line 36 to product stripper 16. Steam from line 40 strips the liquid hydrocarbon products from the mixture and resulting stripped products are taken through cyclone 37 and then through line 38 to product bubble tower 21.

A portion of the heavy gas oil from the bottom of the product bubble tower is taken through line 62 to slurry mixer 22 where it is mixed with pulverized coal from 23 to form a pumpable slurry. The slurry is then taken through line 63 to thermal retort 17 where the slurry oil is subjected to thermal cracking and the coal is pyrolyzed. The remaining spent shale and slurry oil from product stripper 16 enters thermal retort 17 through line 39 and valve 39*a*. The mixture is subjected to two different temperature levels by means of adding spent shale and coal char that has been burned in an air lift combustor so as to effect a temperature gradient as required to vaporize slurry oil and thermally retort hydropyrolysis spent shale; the upper level receiving burned shale and coal char from line 41 and the lower level receiving burned shale and coal char from line 42. The combined gas and liquid products from the thermal retort chamber are taken in vapor phase through line 17*a* to cyclone 46 and thence through line 47 to recycle quench tower 19. The spent shale and coal char from the bottom of thermal retort 17 is taken through line 43 to the bottom of the air combustor 18. The spent shale and coal char is forced up the column by air from line 56 under combustion conditions. For the top of the air lift combustor the burned shale and coal char goes through line 48 to cyclone 48*a* and thence through line 49 to take off line 41, take off line 42 and take off line 49*a* (to the fluid bed combustor), and then to join line 43. Ash removed from the fluid bed combustor 45 passes via line 64 through cooler 65 to line 66 for disposal. From cyclone 48*a*, waste gas goes through line 50 to the waste heat boiler.

The combined gas and liquid product from the thermal retort is taken through line 17*a* to cyclone 46 and thence through line 47 to quench tower 19. From the quench tower, the gas is removed at line 51, the cracked gasoline and light gas oil is removed through lines 52 and 53 and recycled to the hydropyrolysis reactor 14. The slurry gas oil is taken through line 55 to the slurry oil heater 20 and thence through line 32 recycled to slurry mixer 13.

The liquid hydrocarbon product taken to the product bubble tower is fractionated into the desired liquid fractions. The light gasoline is taken off through line 58, the heavy gasoline through line 59 and the light gas oil through line 60. The heavy gas oil is taken off through line 61.

DETAILED DESCRIPTION OF THE INVENTION

As used herein "oil" refers in a generic sense to the hydrocarbon materials which are extractable from the raw oil shale by the process described herein.

The process of the invention will now be described in detail with particular reference to the process flow as illustrated in FIG. 2.

Oil Shale

Any raw oil shale containing kerogen can be used in the process of the invention. Oil shales of the Eocene period generally found in the western United States, and particularly the northwestern area of Colorado and in the adjoining areas of Utah and Wyoming are suitable for use in this invention. These oil shales have an organic carbon to hydrogen wt. ratio typically of less than 8:1 and usually 7:1 to 8:1, and Fisher Assays in the order of 25 gallons per ton of ore. Oil shales having large quantities of "Black Shale" from deposits such as Devonian and Mississippian, generally found in the eastern portion of the United States are especially suitable for use in the process of the invention. These oil shales have been found to have organic carbon to hydrogen weight ratios typically in the order of 8:1 to about 10:1, and Fisher Assays of less than 15 gallons of oil per ton of ore. The process of the invention is also particularly useful for other shales found throughout the world, such as those found in Australia.

The following table gives estimate compositions both of the organic and inorganic portions of typical "Eastern" and "Western" oil shales.

| | SOURCE OF THE OIL SHALE | |
|---|---|---|
| | KENTUCKY (Eastern) | COLORADO (Western) |
| | WEIGHT PERCENT | |
| Organic | | |
| Carbon | 12.0 | 13.6 |
| Hydrogen | 1.3 | 1.9 |
| Sulfur | .3 | 0.3 |
| Nitrogen | .4 | 0.5 |
| Oxygen | 1.0 | 1.7 |

-continued

| | SOURCE OF THE OIL SHALE | |
|---|---|---|
| | KENTUCKY (Eastern) | COLORADO (Western) |
| | WEIGHT PERCENT | |
| Carbon/hydrogen | 9.2 | 7.2 |
| Inorganic | | |
| Carbon Dioxide | 0.5 | 15.9 |
| Water | 4.0 | 1.8 |
| Sulfur | 4.4 | 0.2 |
| Ash | 78.3 | 66.8 |
| Fisher Assay (gal/ton) | 12 | 30 |

CRUSHING AND GRINDING OF RAW OIL SHALE

The raw oil shale is crushed and ground to form particles preferably having a mesh size less than 10 mesh. Particularly good results are obtained when the mesh size is finer than 20 mesh and especially between 20 and 200 mesh.

The crushing and grinding of the raw shale can be accomplished by any suitable means, such as commercial impact crushers, cone crushers, jaw crushers, ball mills, roller mills and the like, the particularly equipment to be employed will depend chiefly on the type of shale and oil content thereof.

DRYING AND HEATING OF SHALE PARTICLES

The shale particles are subjected to a drying and heating step, preferably to reduce heat load and water content in the hydropyrolysis system. This is accomplished by passing the shale into the gas lift drier heater 12 as shown in the drawing where the particles are exposed to hot flue gas from the fluid bed combustor 70 described hereinafter or other source of hot non-oxidizing gas.

The temperature employed in the drying and heating step may vary over a wide range. In general, the temperature employed will vary from about 100 degrees C. to 300 degrees C., and more preferably from 200° to 275° C. and limited such that insignificant thermal retorting take place. The heating should be sufficient to reduce the free water content of the shale to a low level.

SLURRY MIXER

The heated and dried shale particles are passed to the cyclone 28 and then to the slurry mixer 13. Here it is mixed with a slurry oil which has been heated to about 350 degrees C. to about 400 degrees C. in slurry oil heater 20.

The slurry oil used in this step may be any oil produced in the process and preferably a refractory high boiling material that can withstand temperatures of 350 degrees C. to 425 degrees C. at the exit of slurry oil heater 20 without undergoing significant thermal cracking. This oil generally has the following properties: Boiling range 375 degrees C. to 475 degrees C., UOP $K = < 11.5$.

The amount of slurry oil employed in making the slurry with the crushed shale particles may vary over a wide range. In general, it is desirable to use a shale to oil weight ratio of at least 0.6:1 to about 1.7:1, and still more preferably a shale to oil ratio of 1.5:1. The upper limit of the amount of shale employed is determined by the fluid flow characteristics of the slurry formed.

The oil used in preparing the slurry is preferably heated to an elevated temperature before being mixed with shale particles. The temperature employed generally varies from about 350 degrees C. to about 425 degrees C. In commercial operations, the recycle heavy oil will be heated in the slurry oil heater 20 to the desired temperature required to operate the hydropyrolysis reactor at the desired reactor temperature. In general, such oil will have a temperature ranging from about 375 degrees C. to about 400 degrees C.

The formation of the slurry may be accomplished by any suitable method. It is generally formed by injecting the heated oil over the shale particles and stirring with a mechanical stirrer so as to effect a thorough mixing of the oil and the shale particles in a manner similar to slurry pipeline operation.

HYDROPYROLYSIS REACTOR

The slurry formed as above with the shale particles and the slurry oil is then pumped into a pressurized hydropyrolysis reactor 14 where it is treated with hydrogen from line 15 at an elevated temperature and pressure.

The pressure within the hydropyrolysis reactor 14 will generally vary from about 500 psi to about 2500 psi, and still more preferably between about 1000 psi and 1500 psi.

The temperature to be maintained in the hydropyrolysis reactor should be maintained within the range needed to accomplish the desired level of carbon conversion. In general, the temperature will vary from 400° C. to 425° C. and usually from 425° C. to 450° C. As the hydropyrolysis reaction is exothermic, it is necessary to take steps to maintain the temperature within or near the above range, e.g. within 25 degrees thereof. This is preferably accomplished by recycling a portion of the reaction mixture near the top of the chamber to the bottom of the chamber by means of recycle pump 24, although other techniques for controlling the temperature may be utilized. Control of temperature gradient within the hydropyrolysis reactor 14 preferably ± less than 25 degrees C. is an important feature of this invention in limiting gas make in the hydropyrolysis section of the process.

The hydrogen used in the above noted hydropyrolysis reactor is preferably that produced on site from recovered gases and liquids in a conventional hydrogen plant, and hydrogen gas is compressed to the desired pressure and introduced at the bottom of the hydropyrolysis reactor.

The residence time in the hydropyrolysis reactor may vary depending on the type of shale and temperature and pressure utilized. In general, the residence period will range from about 2 to 3 minutes up to about 60 minutes. Preferably the residence time will vary from about 10 to 15 minutes, as it has generally been found that by this time the kerogen has been hydropyrolized to a yield corresponding to about 85–95% of the combined hydropyrolysis/thermal yield.

PRODUCT STRIPPER

The product obtained from the above-described hydropyrolysis reactor is discharged to a product stripper 16 where the liquid product and a portion of the recycle slurry oil is vaporized at a temperature of about 425 degrees C. The vapors are passed out of the product stripper through cyclone 37 to the product bubble tower and associated recovery facilities.

PULVERIZED COAL

Any suitable pulverized coal particles can be used in the process. Bituminous and subbituminous coals are preferred, however, anthracite or lignite may be used if necessary. The bituminous coals are considered to be plentiful in western United States where large quantities of raw oil shale are available and thus both raw materials can be obtained at the same source and thus avoid costly transportation problems.

The coal is preferably crushed and ground to form particles preferably having a mesh size less than 10 mesh. Particularly good results are obtained when the mesh size is finer than 20 mesh and especially between 20 and 200 mesh.

According to the process of the invention, the pulverized coal is taken from feed coal hopper 23 and passed to coal slurry mixer 22 where it is mixed with heavy gas oil to form a pumpable slurry. The heavy gas oil used is preferably that removed from the bottom of the bubble tower 21. The temperature of the oil so mixed with the coal will generally vary from about 200° C. to 300° C.

The amount of pulverized coal employed in making the slurry with the heavy gas oil may vary over a wide range. In general, it is desirable to use a coal to oil weight ratio of about 0.25:1 to 1:1. The amount of coal employed is generally determined by the energy balance of the plant and the amount of fuel required in fluidized bed combustor 45.

The slurry formed in 22 is then passed to the thermal retort through line 63 in order to pyrolyze the coal and thermally crack the oil.

THERMAL RETORT

The spent shale and slurry oil from the hydropyrolysis reactor is taken through line 39 to the fluidized bed thermal retort 17 where it is subjected under pressure to a temperature gradient such that the slurry oil is vaporized and the spent shale is thermally retorted. Spent shale and coal char burned in the air lift combustor is introduced at the upper level treatment zone through line 41 in sufficient quantity to maintain a temperature of about 450 degrees C. to 500 degrees C. and vaporize the remaining slurry oil. Additional burned spent shale and coal char is introduced to a lower level through line 42 in sufficient quantity to maintain a temperature in the range of 500 degrees C. to 650 degrees C. and to effect thermal retorting of organic carbon and hydrogen remaining in the spent shale and pyrolyze the coal and thermally crack heavy gas oil charged to this zone of the retort to produce lighter products, such as gasoline and diesel oil.

Temperature at various levels in the thermal retort can be controlled by the location, and rate of injection of the burned shale and coal char.

While the above process has been described in terms of two levels, it should be understood that additional levels of injection of the burned shale and coal char can be utilized as needed or desired to optimize thermal retorting of spent shale and coal char leaving the hydropyrolysis reactor and thermal cracking of excess heavy oil. It should be understood that the requirements of thermal retort 17 can be accomplished in equipment systems other than the fluidized bed described above, such as the screw mixer employed in the Lurgi LR retort.

The hydrogen/carbon atomic ratio of spent shale leaving the thermal retort is very low, and in some cases less than 0.5 while hydrogen content of the hydropyrolized shale entering the thermal retort may be relatively high, depending on operating conditions and the characteristics of specific shales.

The spent shale and coal from the thermal retort is taken to the bottom of the air lift combustor through line 43.

QUENCH TOWER

The combined gas and liquid products of the thermal retort are taken through line 47 to recycle quench tower 19. The light gas oil and gasoline range products from this tower are recycled to the hydropyrolysis reactor through line 52*a*, and the heavy gas oil is heated in slurry oil heater 20 and then recycled through line 32 to the slurry mixer 13.

The temperature at the bottom of the quench tower will vary from about 275 degrees C. to 325 degrees C.

The temperature at the outlet of the slurry oil heater will generally vary from about 375° C. to about 400° C.

AIR LIFT COMBUSTOR

The spent shale and coal from the thermal retort is taken through line 43 to the bottom of the air lift combustor where it is burned at a temperature of about 850 degrees C. while being forced upward by the air entering line 56. The height of the clumn being selected so as to provide the necessary pressure control over the process as described.

PRODUCT BUBBLE TOWER

The product from the product stripper as described above is taken to the product bubble tower through line 38 where it is subjected to conventional fractionation techniques. A partial range of products obtained from such fractionation include the following:

Light Gasoline (Boiling range) 50 deg. C.–120 deg. C.
Heavy Gasoline (Boiling range) 120 deg. C.14 200 deg. C.
Light Gas Oil (Boiling range) 200 deg. C.–350 deg. C.

The process of the present invention is characterized by the improved yields of the above-described products as well as their improved quality.

Such products will, for example, be substantially free of unsaturated hydrocarbons, such as olefinic compounds and have significantly reduced amounts of the complex organic-nitrogen, oxygen and sulfur compounds which are so prevalent in the prior known products, and thus have better color and stability.

The products obtained by the new process are also distinquished from those obtained from prior known oil shale in that they contain significantly larger percentages of cyclic or aromatic type hydrocarbons by reason of the coal pyrolysis step in the process. Consequently, the product is more characteristic of the crude oils obtained from conventional oil production. Depending on the amount of coal used, the aromatic content may increase by as much as ten percent.

PREFERRED EMBODIMENT OF THE INVENTION

A preferred method of operation of the process of the invention is described below. It should be understood that this is given as an illustration of the operation of the process and is not to be considered as limiting the invention in any way.

Raw Devonian shale obtained from Montgomery County, Ky. is crushed to about minus 20 mesh size.

The crushed shale is then heated and dried at a temperature of about 275 degrees C. while passing through the gas lift dryer/heater to obtain particles having the desired water content.

The dried heated shale particles are then mixed with hot recycle heavy oil heated to a temperature of about 350 degrees C. to 400 degrees C. in a shale to oil weight ratio of 1:1. The mixture was prepared using conventional mechanical mixing for a period of about 2 to 5 minutes.

The above-noted oil/shale slurry is then passed into a pressurized hydropyrolysis reactor where it is treated with hydrogen under pressure of about 1000 psi and a temperature of 425 degrees C. to 450 degrees C. for a residence period of about 15 minutes. During the reaction, a portion of the slurry was recycled to maintain the temperature within the above range and thus minimized the gas production in the reaction.

The product from the hydropyrolysis chamber is then taken to the product stripper where the desired liquid products are steam stripped at a temperature of about 425 degrees C. and taken to the product bubble tower for fractionation into the desired products.

A portion of the heavy gas oil from the bottom of the product bubble tower is taken to the coal slurry mixer where it is combined with pulverized coal from the feed coal hopper. The coal employed here was bituminous coal pulverized to about 20 mesh or finer. The heavy gas oil and the coal particles were combined in a weight ratio ranging from 0.25:1 to 1:1 depending on the operating requirements.

The slurry so formed with the pulverized coal is then charged to the thermal retort. The coal is pyrolyzed and the coal thermally cracked. The remaining spent shale and slurry oil from the product stripper is charged to the lower temperature zone of the thermal retort where slurry oil is vaporized. The spent shale subsequently passes to the higher temperature zone where thermal retorting is accomplished. A temperature gradient is maintained in the thermal retort by adding spent shale and coal char that has been burned in the air lift combustor. The upper treatment zone is maintained at a temperature of about 450 degrees C. to 500 degrees C. so as to effect vaporization of the remaining slurry oil. The lower level treatment zone is maintained at a temperature ranging from about 525 degrees C. to about 575 degrees C. so as to effect thermal racking of the excess heavy oil to produce lighter products, pyrolyze coal and thermally retort spent shale from the hydropyrolysis reactor.

The combined gas and liquid products from the thermal retort are taken to a quench tower where the liquid products recovered at a temperature of 150 degrees C. to 250 degrees C. are recycled to the hydropyrolysis reactor and the heavy oil recovered at a temperature of 300 degrees C. is passed to a heater where it is heated to a temperature of 375 degrees C. to 400 degrees C. and recycled to the slurry mixer.

The spent shale and coal is removed at the bottom of the retort chamber and passed to the bottom of the air lift combustor where it is burned at a temperature of about 850 degrees C.

The yield of product was about 250% of the Fisher Assay which was about 30 gallons per ton of shale. There was an increase of about 5% in the aromatic content of the product.

Analysis of the combined product obtained at the bubble tower is as follows:

Initial Boiling Point—80 degrees C.
95% Point—350 degrees C.
API Gravity—43
nitrogen Wt.%—0.5

When the above procedure is repeated using a Western shale obtained from Green River, the yield of product is about 150% of Fisher Assay which was about 45 gallons per ton of shale.

I claim as my invention:

1. A continuous process for treating raw oil shale to produce shale oil of improved quality and yield and reduced cost which comprises the following steps:

a. crushing and grinding the raw oil shale,
b. heating and drying the crushed and ground shale,
c. passing the heated and dried shale particles to a slurry mixer where they are mixed with hot heavy oil recycle.
d. passing the slurry into a pressurized hydropyrolysis chamber where it is treated with hydrogen under a pressure of 500 to 2000 psi and a temperature of 400 degrees C. to 475 degrees C. for a short residence time, and taking steps during this reaction to prevent the temperature from rising more than about 25 degrees C. above the aforementioned range,
e. discharging the hydropyrolysis reaction mixture into a product stripper wherein the product hydrocarbons and a portion of the recycle slurry oil is vaporized and passed to a separation column where the desired fractions are removed and heavy gas oil recovered,
f. mixing the heavy gas oil so recovered with pulverized coal particles to form a pumpable slurry to be charged to the high temperature zone of a thermal retort,
g. passing spent shale and slurry oil from the product stripper to a fluidized bed thermal retort in which a temperature gradient is maintained by introducing spent shale and coal char that has been burned in an air lift combustor into at least two different treatment zones, the upper zone being selected such that the temperature is sufficient to vaporize the remaining slurry oil, and the lower zone being selected such that the temperature is sufficient to thermally retort residual organic carbon and hydrogen remaining after hydropyrolysis, pyrolyze coal charged to the lower zone and to thermally crack the excess heavy oil charged to this zone of the reactor.
h. taking the combined gas and liquid product to a quench tower where the liquid product is recycled to the hydropyrolysis reactor and the heavy gas oil is recycled to the slurry mixer.
i. and discharging the spent shale and coal char at the bottom of the thermal retort chamber to the air lift combustor.

2. A process as in claim 1 wherein the amount of coal added to the system is the amount required to maintain the plant in energy balance.

3. A process as in claim 1 wherein the raw oil shale and the coal used in the process are crushed to a particle size of minus 20 mesh.

4. A process as in claim 1 wherein the crushed raw oil shale is heated to a temperature of about 100 degrees to 350° C.

5. A process as in claim 1 wherein the shale and heavy gas oil are combined in the slurry mixer in a weight ratio varying from about 0.6:1 to 1.5:1.

6. A process as in claim 1 wherein the residence period is the hydropyrolysis chamber varies from about 1 to 60 minutes.

7. A process as in claim 1 wherein the temperature in the hydropyrolysis reactor is maintained at the desired level by controlling the slurry oil heater outlet temperature.

8. A process as in claim 1 wherein the temperature gradient in the hydropyrolysis reactor is limited by recycling a portion of the slurry reaction mixture from the top to the bottom of the chamber or by other means.

9. A process as in claim 1 wherein the temperature gradient in the thermal retort is maintained such that the upper level treatment zone is maintained at a temperature of 450° C. to 500° C. and the temperature of the lower level treatment zone is maintained at a temperature range of 500° C. to 650° C.

10. A process as in claim 1 wherein the ratio of the amount of carbon in the coal added to the process to the amount of organic carbon in the raw shale is from 0.01:1 to 0.5:1.

11. A process as in claim 11 wherein the coal employed is a bituminous or sub-bituminous coal.

12. A process as in claim 1 wherein the raw shale is a Devonian shale.

13. A process as in claim 1 wherein the raw oil shale is an Eocene shale.

14. A process as in claim 1 wherein the raw oil shale is a Kentucky shale.

15. A process as in claim 1 wherein the raw oil shale is an Australian shale.

* * * * *